US005657746A

United States Patent [19]

Christianson

[11] Patent Number: 5,657,746

[45] Date of Patent: Aug. 19, 1997

[54] SNORKEL WITH AUTOMATIC PURGE

[76] Inventor: Tony Christianson, 2007 Wawona Station, Yosemite, Calif. 95389

[21] Appl. No.: 562,523

[22] Filed: Nov. 24, 1995

[51] Int. Cl.[6] ..... B63C 11/16

[52] U.S. Cl. ..... 128/201.11; 128/201.27; 128/201.28

[58] Field of Search ..... 128/201.11, 201.27, 128/201.28

[56] References Cited

U.S. PATENT DOCUMENTS

| | | | |
|---|---|---|---|
| 2,317,236 | 4/1943 | Wilen | 9/20 |
| 2,408,166 | 9/1946 | Hawkins | 128/145 |
| 2,931,057 | 4/1960 | Vilarem | 9/339 |
| 3,140,551 | 7/1964 | Wayfield | 128/201.11 |
| 3,345,984 | 10/1967 | Katehis | 128/201.11 |
| 3,721,236 | 3/1973 | Bardehle | 128/201.11 |
| 4,071,024 | 1/1978 | Blanc | 128/145 A |
| 4,278,080 | 7/1981 | Schuch | 128/201.11 |
| 4,793,341 | 12/1988 | Arasmith | 128/201.11 |
| 4,805,610 | 2/1989 | Hunt | 128/201.11 |
| 4,872,453 | 10/1989 | Christianson | 128/201.11 |
| 4,877,022 | 10/1989 | Christianson | 128/201.11 |
| 4,879,995 | 11/1989 | Christianson | 128/201.11 |
| 5,092,324 | 3/1992 | Christianson | 128/201.11 |
| 5,117,817 | 6/1992 | Hsin-Nam-Lin | 128/201.11 |
| 5,143,059 | 9/1992 | Delphia | 128/201.11 |
| 5,199,422 | 4/1993 | Rasncha | 128/201.11 |
| 5,261,396 | 11/1993 | Faulconer et al. | 128/201.11 |
| 5,280,785 | 1/1994 | Fujima | 128/201.11 |
| 5,351,681 | 10/1994 | Hudson | 128/201.11 |

*Primary Examiner*—Aaron J. Lewis

[57] ABSTRACT

The present invention is an improved skin diving snorkel having a conduit with an open end above water and an underwater end which has a mouthpiece. The mouthpiece provides a flow path from the conduit to the interior of the diver's mouth. A purge valve, situated in a chamber below the mouthpiece, allows water in the snorkel to flow to ambient when hydrostatic pressure within the snorkel is greater than ambient.

The conduit houses a buoyant member. The buoyant member freely runs the length of the conduit. When the snorkel is free of water, the buoyant member rests in the chamber below the mouthpiece, completely out of the respiratory flow path. The buoyant member floats or is carried upward when water is in the snorkel. A seat, adjacent the open end of the snorkel, prevents the buoyant member from exiting the conduit. The seat also forms a substantially fluid-tight closure when the buoyant member rests against it.

The flooded snorkel is purged by exhaling normally into the mouthpiece. An explosive blast of air is not required or desirable. The ascending air and water lifts the buoyant member until it rests against the seat. Because the buoyant member substantially blocks continued upward flow, the bulk of the upwardly expanding exhaled air is trapped beneath the buoyant member. The trapped air displaces the water in the conduit, forcing the water down and out the purge valve. Exhalation pressure holds the buoyant member in the blocking position until the purging exhalation is complete. Release of exhalation pressure at the start of inhalation allows the buoyant member to drop below the mouthpiece, clearing the conduit for unrestricted respiration. The entire purging sequence can take place automatically, that is, without conscious effort by the diver.

16 Claims, 12 Drawing Sheets

SNORKEL WITH AUTOMATIC PURGE

BACKGROUND OF THE INVENTION

1. Related Patents

The present application is an improvement of the invention taught by the applicant's application Ser. No. 292,224 filed Dec. 30, 1988 now U.S. Pat. No. 4,872,453.

2. Field of the Invention

The present invention is generally related to snorkels used by skin divers. More particularly, this invention is concerned with purging water from a flooded snorkel.

3. Description of the Prior Art

Skin divers use the snorkel as a means to breathe while swimming face down on the water surface. The snorkel functions as a conduit between the diver's mouth and the overhead air. One end of the snorkel conduit is open and typically extends a short distance above the water surface. Occasionally, due to swimming movements or wave action, small amounts of water flow into the open end of the snorkel and partially flood the conduit. Also, water will flood the snorkel when the diver swims or dives below the water surface. An experienced skin diver can sense when water enters the snorkel and responds by immediately stopping inhalation. Respiration is resumed after the snorkel has been purged of water.

A diver returning to the surface after an underwater swim will be starved for air. Upon reaching the surface and after the snorkel is purged, the first breaths through the snorkel are typically fast and deep. The diving community considers snorkels which provide air with little respiratory resistance to be very desirable. Accordingly, to ease respiration, the state of the art sizes the inside cross-sectional area of the conduit to provide respiratory flow with as little resistance as possible. Equally important for the state of the art, the conduit must be free of any obstructions or flow restricting structures which hinder respiratory flow.

In addition, there are other considerations of the art concerning the size of the conduit. Overly large conduits add significantly to the bulk of the snorkel which makes the snorkel undesirably cumbersome and difficult to swim with. And as will be discussed shortly, water cannot be easily purged from overly large conduits.

Inexperienced skin divers find occasional flooding especially troublesome because, undetected, water can be inhaled resulting in coughing and extreme discomfort. Consequently, several configurations have been proposed to restrict or block the normally open end of the snorkel and thereby prevent water from entering.

U.S. Pat. No. 2,317,236 entitled Breathing Apparatus for Swimmers, issued to C. H. Wilen, et al, on Apr. 20, 1943, teaches a valve with a buoyant ball arranged to block the above water end of the snorkel whenever water starts to enter. Such valves are bulky, often fail to seal and, also, significantly increase respiratory effort. Although once popular, such devices are now considered unreliable and obsolete.

A recent invention functionally similar to the snorkel of Wilen, U.S. Pat. No. 5,117,817 entitled Vertical Co-Axial Multi-Tubular Diving Snorkel, issued to Hsin-Nan Lin on Jun. 2, 1992 teaches an annular float arrangement which blocks the above water end of the snorkel whenever water starts to enter. To assist in purging, the Lin snorkel also incorporates a secondary purge tube within the breathing conduit. The Hsin-Nan Lin snorkel suffers from the same problems as the Wilen snorkel.

U.S. Pat. No. 4,071,024 entitled Snorkel, issued to Max A. Blanc on Jan. 31, 1978, teaches an air entrapping cap which is mounted on the above water opening of the snorkel. A tortuous passage in the cap retards water flow into the snorkel. Although such a cap is somewhat effective in blocking the occasional flow of surface water into the snorkel, it also retards expulsion of water which enters the snorkel during a dive or swim below the water surface. The significant increase in respiratory and purging effort limits its utility and subsequent popularity.

Similar to Blanc, U.S. Pat. No. 5,199,422 entitled Modular Snorkel, issued to Stan Rasocha on Apr. 6, 1993, teaches an exhaust valve mounted on a cap which covers the upper end of the snorkel. The cap restricts the entry of splashed water into the snorkel. The exhaust valve on the cap permits the expulsion of water from within the snorkel during a purging exhalation. Rasocha's snorkel increases respiratory effort and does not noticeably reduce purging effort.

The open snorkel conduit will be completely flooded with water when a skin diver returns to the surface after swimming or diving underwater. The open end of the snorkel is above the water when the skin diver swims face down on the water surface. With the open end of the snorkel above the water, the conduit is purged for respiration by exhaling an explosive blast of air into the mouthpiece.

Surface tension forms the purging blast of air into a bubble which spans the cross section of the conduit. Pressure within the bubble expands the bubble toward the open end of the snorkel conduit. As the leading surface of the bubble moves away from the mouthpiece, the bulk of the water within the conduit is pushed ahead of the bubble and out the open end.

However, the purging bubble of air will slip past water which adheres to the inside surface of the conduit. Consequently, the size and shape of the cross-section of the snorkel conduit greatly affects the purging action of the expanding bubble. For example, if the inside cross-section is overly large, the expanding bubble will tend to concentrate more in the center of the conduit cross-section and, consequently, substantially more water will adhere to the conduit wall. Also, if the conduit cross-section shape is other than circular, e.g. elliptical or rectangular, the circular shape of the expanding bubble will tend to miss water outside the circular center of the conduit. In addition, structures within the conduit, or attached to the open end of the conduit, not only restrict respiration but interfere with the purging flow as well. Such structures are customarily avoided by the art.

In general, snorkels having larger cross-sections breath noticeably easier but purge poorly; conversely, snorkels having smaller cross-sections breath poorly but purge more completely. And snorkels having circular cross-sections breath and purge easier, but are not as streamlined for swimming as, for example, an elliptical cross-section. Choice of the size and shape of the snorkel conduit by the art is a compromise which considers the various factors. Based on years of experience by those who manufacture and sell snorkel equipment, and tested by the popular acceptance of the diving community, the optimum snorkel configuration has an open, unobstructed circular cross-section with an inside diameter in the range from 19 mm to 22 mm (¾ inch to ⅞ inch). Deviations from this norm have limited success within the diving community.

After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and soon obstructs the conduit. Unless the conduit is completely blocked, a slow and cautious inhalation is possible after which another purging exhalation can be made.

The respiratory effort needed to purge a snorkel is significant. Many skin divers lack the respiratory strength needed to completely purge a flooded snorkel with a single exhalation, and must repeat the purging procedure several times. Also, water will sometimes enter the snorkel just as the diver has completed an exhalation, leaving very little air in the lungs to satisfactorily complete a purge. Consequently, a means which decreases the respiratory effort and the amount of air required to purge a snorkel will be very beneficial.

A popular solution places an externally directed purge valve in the wall of the snorkel conduit at a location near the snorkel mouthpiece. Water in the flooded conduit which extends above the ambient water surface will drain through the purge valve. Because the total volume of water in the flooded snorkel is reduced by water flow through the purge valve, the respiratory effort required to purge the remaining water is also reduced.

Unfortunately, a purge valve also provides an alternate path for forcefully exhaled air. A purge valve located close to the mouthpiece will quickly and wastefully dissipate the explosive blast of purging air. One solution to this problem places the purge valve at a location approximately midway between the mouth opening and the open end of the snorkel conduit.

At mid-length of the snorkel conduit, the purge valve will be close to the ambient water surface when the skin diver is swimming face down on the water surface. At such a location, the purge valve will drain that portion of the snorkel conduit which extends above the water surface, but will not initially interfere with the purging blast of air. Even at this location, the purge valve will dissipate the forcefully exhaled air and the amount of residual water adhering to the inner surface of the conduit between the purge valve and the open end will be substantial. The residual water subsequently accumulates at the lowermost portion of the snorkel conduit and obstructs the conduit. Consequently, the purge valve by itself, even when located mid-length of the snorkel conduit, is of limited benefit.

U.S. Pat. No. 4,278,080 entitled Diving Snorkel, issued to Joseph N. Schuch on Jul. 14, 1981, teaches a purge valve located at the bottom of a branch conduit which joins the snorkel conduit at a location approximately midway between the mouthpiece and the open end. The purge valve drains the snorkel conduit until the water level within the conduit matches the ambient water level. Part of the purging air will divert into the branch conduit and force water within the branch conduit out the purge valve. Schuch teaches that the branch conduit must have sufficient length to provide the transient resistance necessary to allow purging of the snorkel conduit before the purging air reaches and is dissipated by the purge valve.

Water within the snorkel conduit of Schuch is pushed out the open end before the purging air clears the branch conduit of water and reaches the purge valve. Nevertheless, diverting part of the purging bubble of air into a branch conduit abates the driving pressure within the purging bubble and allows significant residual water to adhere to the upper portion of the snorkel conduit. Consequently, although the snorkel configuration of Schuch somewhat reduces the effort required to purge a flooded snorkel, it does not decrease the amount of purging air required, and it does not reduce residual water which adheres to the snorkel conduit wall and soon flows down the wall to obstruct the snorkel conduit near the mouthpiece. Also, the branch conduit adds significantly to the size of the snorkel, making the snorkel unwieldy in use.

As another approach, U.S. Pat. No. 5,143,059 entitled Water Trap for a Snorkel, issued to John Delphia on Sep. 1, 1992, teaches a water trap adjacent a purge valve located approximately mid-length on the snorkel. Water flowing within the snorkel is deflected and retained until discharged through the exhaust valve. The trap means of Delphia is a complex combination of baffles, lips and openings which inherently restrict respiratory flow and require relatively complex tooling for manufacturing.

Most of the attempts by the prior art to improve the snorkel have resulted in configurations which in one way or the other obstruct or restrict respiratory flow. As a result, these various configurations have experienced little or no success in the marketplace. In view of these foregoing factors, conditions and problems which are characteristic of the prior art, an improved snorkel was taught by the applicant's application Ser. No. 292,224 filed Dec. 30, 1988 now U.S. Pat. No. 4,872,453 which issued Oct. 10, 1989. The improved snorkel features a chamber that intersects the conduit at a location that is at approximately mid-length. The chamber houses a float member. When the snorkel is free of water, the float member resides in the chamber and does not interfere with respiratory flow. When water fills the snorkel, the float member is buoyed out of the chamber into the conduit and blocks upward flow therein. The flooded snorkel is purged by exhaling into the mouthpiece. Because the float member blocks upward flow when the conduit is flooded, the upwardly expanding exhaled air is trapped beneath the float member. The trapped air displaces the water in the conduit, forcing the water down and out the purge valve. As a consequence, the effort and amount of air required to purge the Christianson snorkel are significantly reduced.

U.S. Pat. No. 4,872,453 satisfied the need for a snorkel with an unobstructed respiratory flow path from which water could be purged with a minimum of respiratory effort and without a wasteful loss of purging air. However, the protruding chamber proved to cause undesirable turbulence during swimming. The intersecting chamber also required relatively complicated and expensive tooling for fabrication. Furthermore, a second purge valve was found to be needed to eliminate water trapped in the snorkel conduit above the chamber intersection. These problems discouraged the practical application of the invention.

The present application improves on the invention taught by U.S. Pat. No. 4,872,453. The improvement eliminates the need for an intersecting chamber located at approximately mid-length of the snorkel tube, yet maintains an open and unobstructed respiratory path when the snorkel is not flooded with water. As a result, the instant invention can be manufactured with relatively simple and inexpensive tooling, swimming turbulence does not occur, and a second purge valve is not needed.

SUMMARY OF THE INVENTION

The present invention is an improved skin diving snorkel having a conduit with an open end above water and an underwater end which has a mouthpiece. The mouthpiece provides a flow path from the conduit to the interior of the diver's mouth. A purge valve, situated in a chamber below the mouthpiece, allows water in the snorkel to flow to ambient when hydrostatic pressure within the snorkel is greater than ambient.

The conduit houses a buoyant member. The buoyant member freely runs the length of the conduit. When the snorkel is free of water, the buoyant member rests in the chamber below the mouthpiece, completely out of the respiratory flow path. The buoyant member floats or is carried upward when water is in the snorkel. A seat, adjacent the open end of the snorkel, prevents the buoyant member from exiting the conduit. The seat also forms a substantially fluid-tight closure when the buoyant member rests against it.

The flooded snorkel is purged by exhaling normally into the mouthpiece. An explosive blast of air is not required or desirable. The ascending air and water lifts the buoyant member until it rests against the seat. Because the buoyant member substantially blocks continued upward flow, the bulk of the upwardly expanding exhaled air is trapped beneath the buoyant member. The trapped air displaces the water in the conduit, forcing the water down and out the purge valve. Exhalation pressure holds the buoyant member in the blocking position until the purging exhalation is complete. Release of exhalation pressure at the start of inhalation allows the buoyant member to drop below the mouthpiece, clearing the conduit for unrestricted respiration. The entire purging sequence can take place automatically, that is, without conscious effort by the diver.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
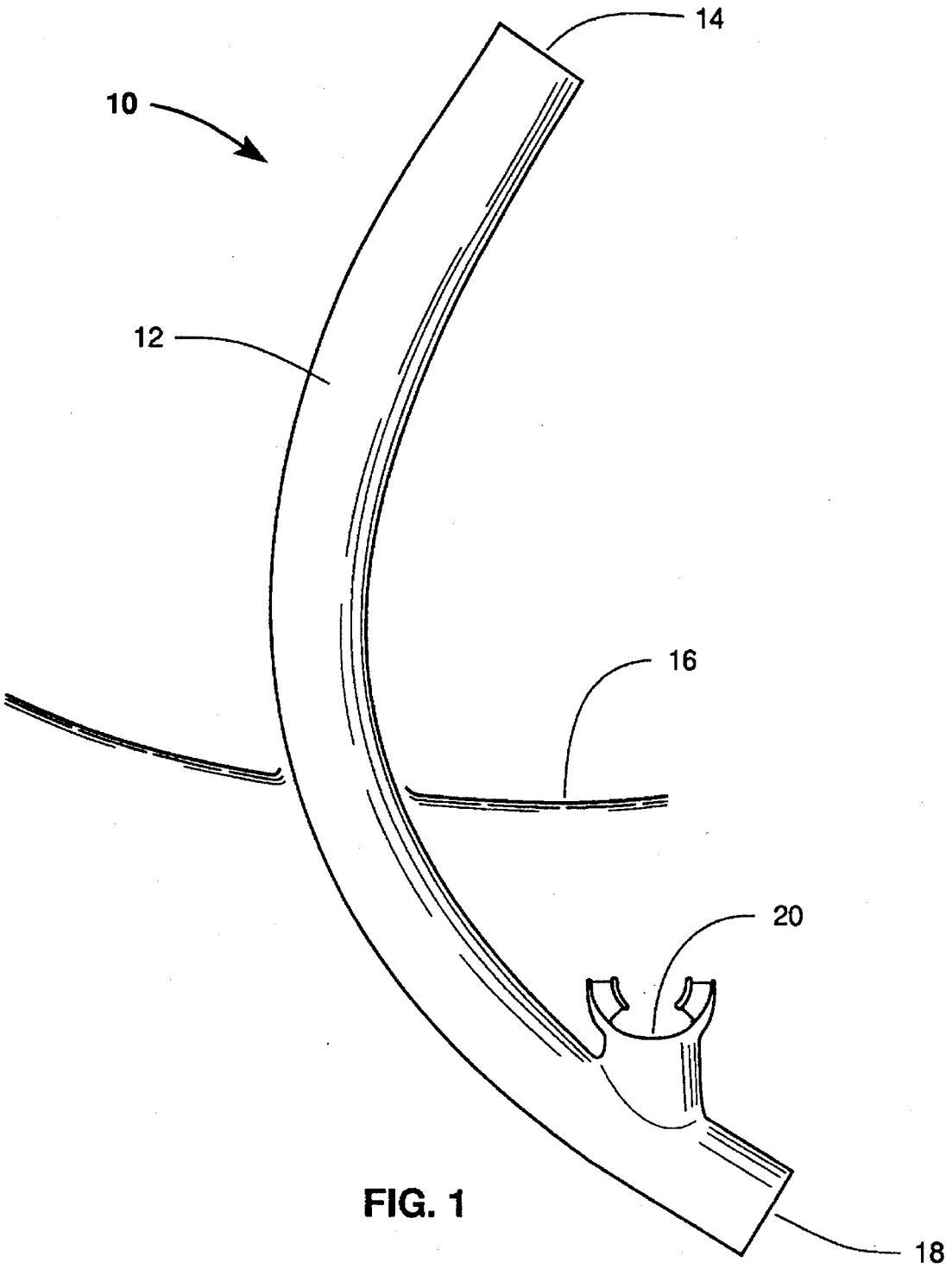
FIG. 1 is a front elevation view of a snorkel which has been constructed in accordance with the principles of the present invention, and which is pictured in the approximate position of use by a skin diver swimming face down on the water surface.
Figure 2:
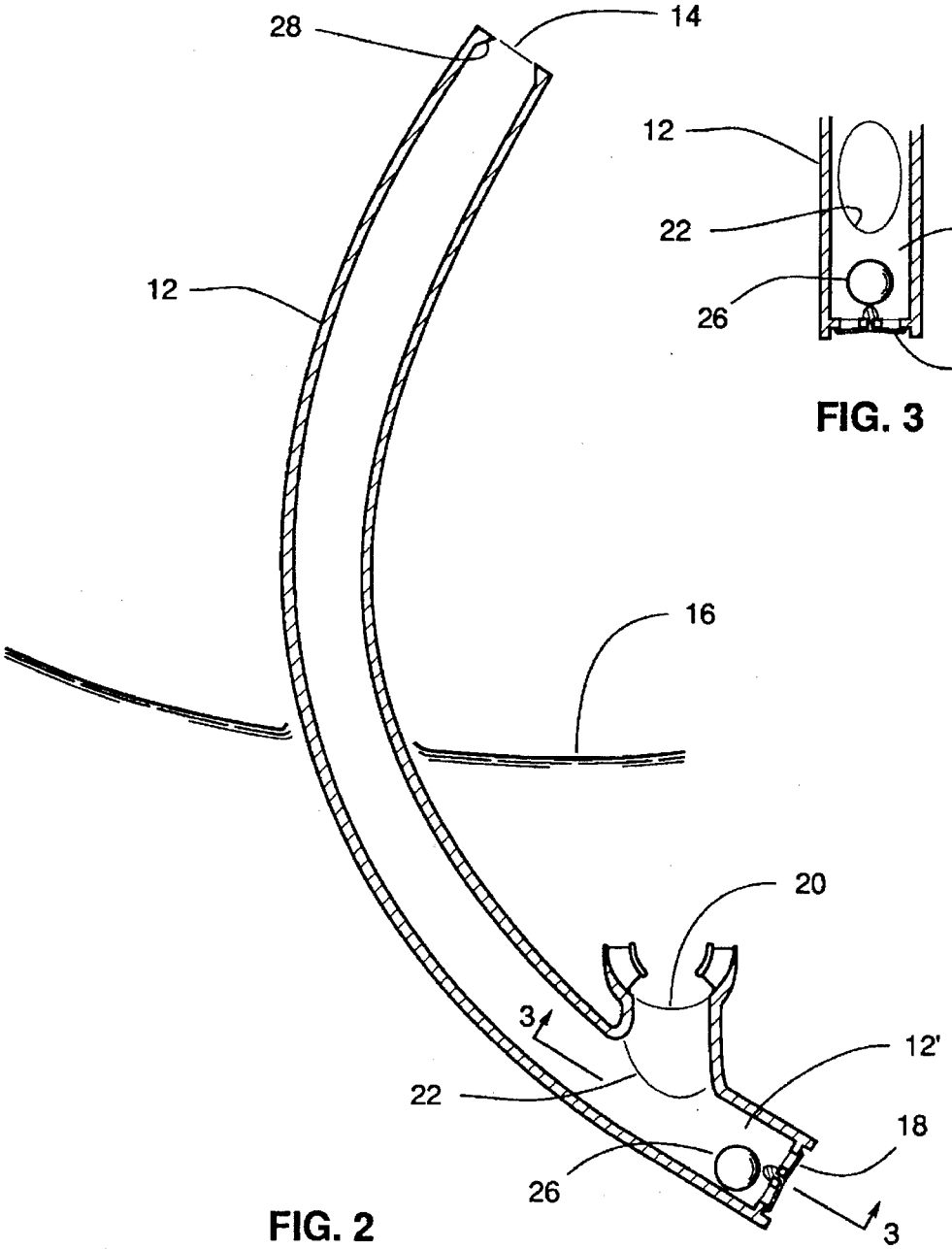
FIG. 2 is a longitudinal sectional view of the snorkel of FIG. 1, shown during respiration.

Referring to FIGS. 1 and 2, improved snorkel 10 is pictured in the approximate position of use by a skin diver swimming face down on the water surface. (For clarity, the diver is not pictured in the FIGS.) Snorkel 10 includes conduit 12 having an upper end with opening 14. The upper end of conduit 12 extends into the air above ambient water surface 16. Air and water can freely enter and exit conduit 12 constitutes a chamber 12' which because opening 14 is not obstructed by valving and related structure or the like, and provides fluid flow there through with little or no resistance. The lower end of conduit 12 constitutes a chamber 12' which is closed by purge valve 18.

Purge valve 18 is oriented to allow water to flow from conduit 12 to ambient. Purge valve 18 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 18 will prevent the reverse flow of ambient water into conduit 12.

Upward opening mouthpiece 20, above purge valve 18, branches from the side of conduit 12. Mouthpiece 20 is adapted to be held by the mouth of the diver and provides a respiratory flow path from conduit 12 to the interior of the mouth. (In the FIGS., the opening of mouthpiece 20 should be considered covered by the diver's mouth.) The intersection of mouthpiece 20 with conduit 12 forms an approximately elliptical opening 22 (as shown best in FIG. 3).

Conduit 12 is configured to approximately match the curvature of the diver's head. The upper portion of conduit 12 curves smoothly to place opening 14 approximately over the center of the head. Alternately, the upper portion of conduit 12 can be straight.

Respiration and purging are facilitated by providing a substantially smooth flow path which is free of any internal structure which may cause turbulence and also avoids abrupt changes in path direction. While not so limited, the curvature may, for example, follow an elliptical path.

Mobile member 26 moves freely within the confines of conduit 12. Accordingly, the inside cross-section of conduit 12 is sized to provide ample clearance with mobile member 26. Purge valve 18 blocks the underwater end of conduit 12. Seat 28, adjacent the top end of conduit 12, prevents mobile member 26 from exiting the above water end of conduit 12. In addition, seat 28 is adapted to form a substantially fluid tight closure with mobile member 26. Consequently, when mobile member 26 rests against seat 28, fluid flow through opening 14 is significantly restricted.

Mobile member 26 has a specific gravity which provides buoyancy in water. Also, mobile member 26 must have structural strength sufficient to resist compressive loading due to ambient water pressure at depths likely to be encountered by a diver.

Although other shapes may be utilized, mobile member 26 is spherical in the preferred embodiment. Correspondingly, in the preferred embodiment seat 28 is a conical shelf or the like sized to nest spherical mobile member 26 such that a substantially fluid tight closure is achieved when mobile member 26 rests against it.

Figure 4:
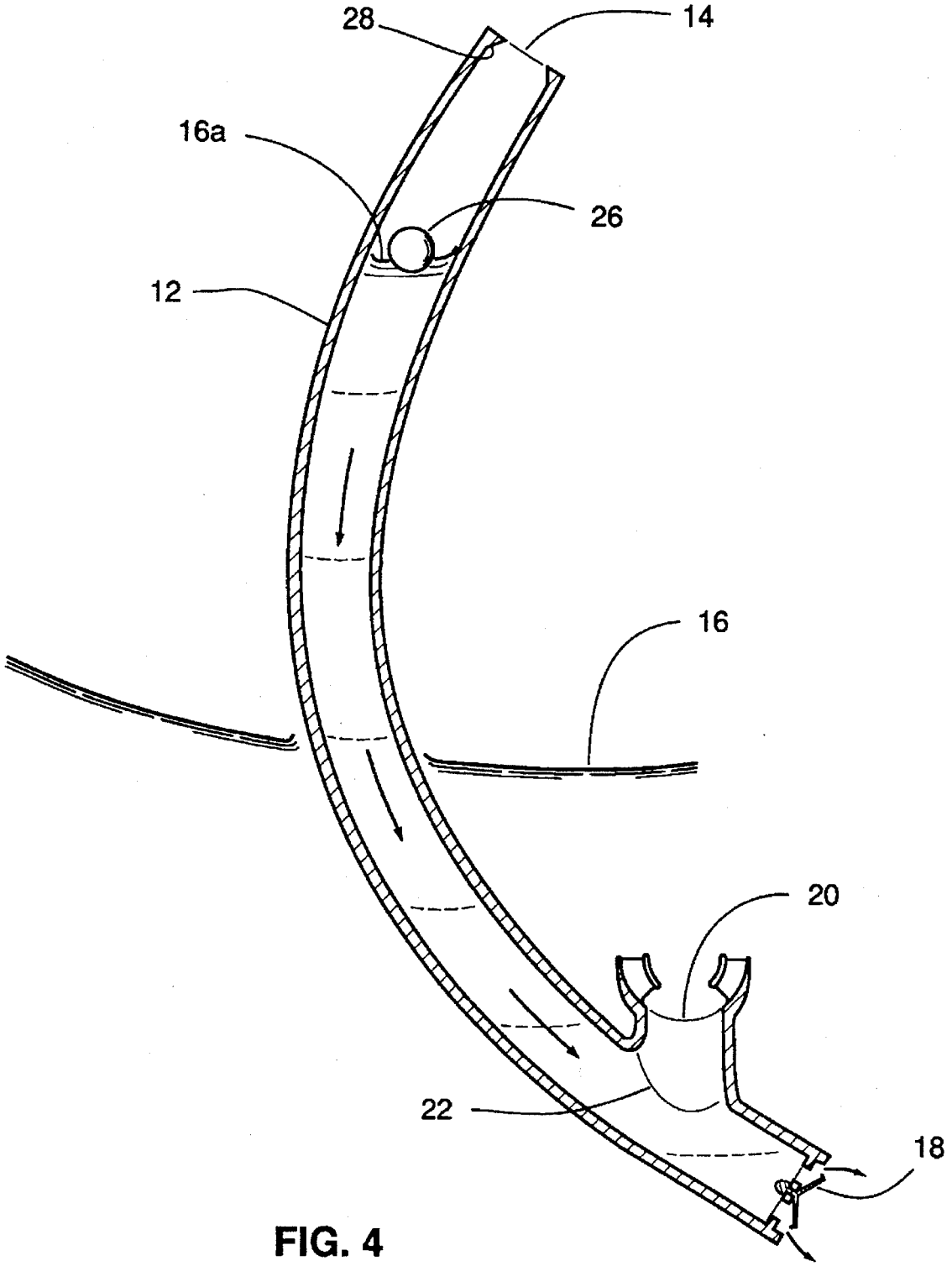
FIG. 4 is a view similar to FIG. 2, showing the snorkel flooded with that portion above the water surface draining to ambient.
Figure 23:
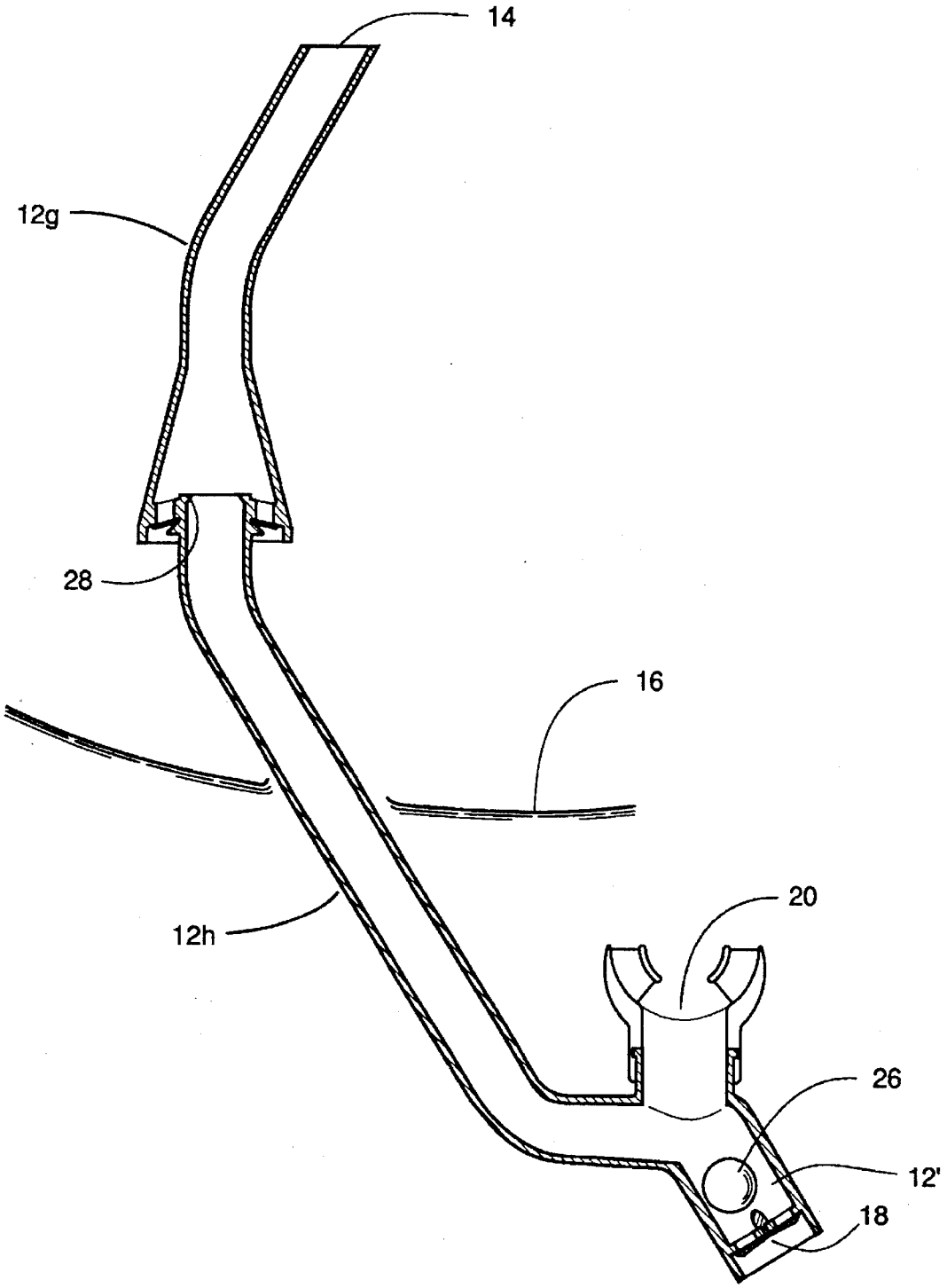
FIG. 23 is a view similar to FIG. 2, showing yet another alternate configuration.

During respiration, conduit 12 is free of water and the force of gravity holds mobile member 26 in chamber 12' under mouthpiece 20. As shown in FIG. 2, chamber 12' can be an extension of conduit 12. Alternately, as shown in FIG. 23, chamber 12' can be a separately formed structure. As also shown in FIG. 2, mobile member 26 is appropriately sized and shaped to be entirely out of the respiratory flow path when mobile member 26 rests in chamber 12'. Referring to FIG. 4, when conduit 12 is filled with water, mobile member 26 is buoyed upward.

When a skin diver swims or dives below the water surface, water will pour into conduit 12 through opening 14, flooding the snorkel. As a consequence of flooding, mobile member 26 is buoyed upward toward seat 28. After the skin diver surfaces and assumes the face down, surface swimming attitude, hydrostatic pressure will cause water (depicted as having surface **16*a* in FIG. 4) within the upper portion of snorkel 10 to flow downward through purge valve 18. Referring to FIG. 4, the outflow of water (depicted as solid arrows) has flexed purge valve 18** outward.

Figure 5:
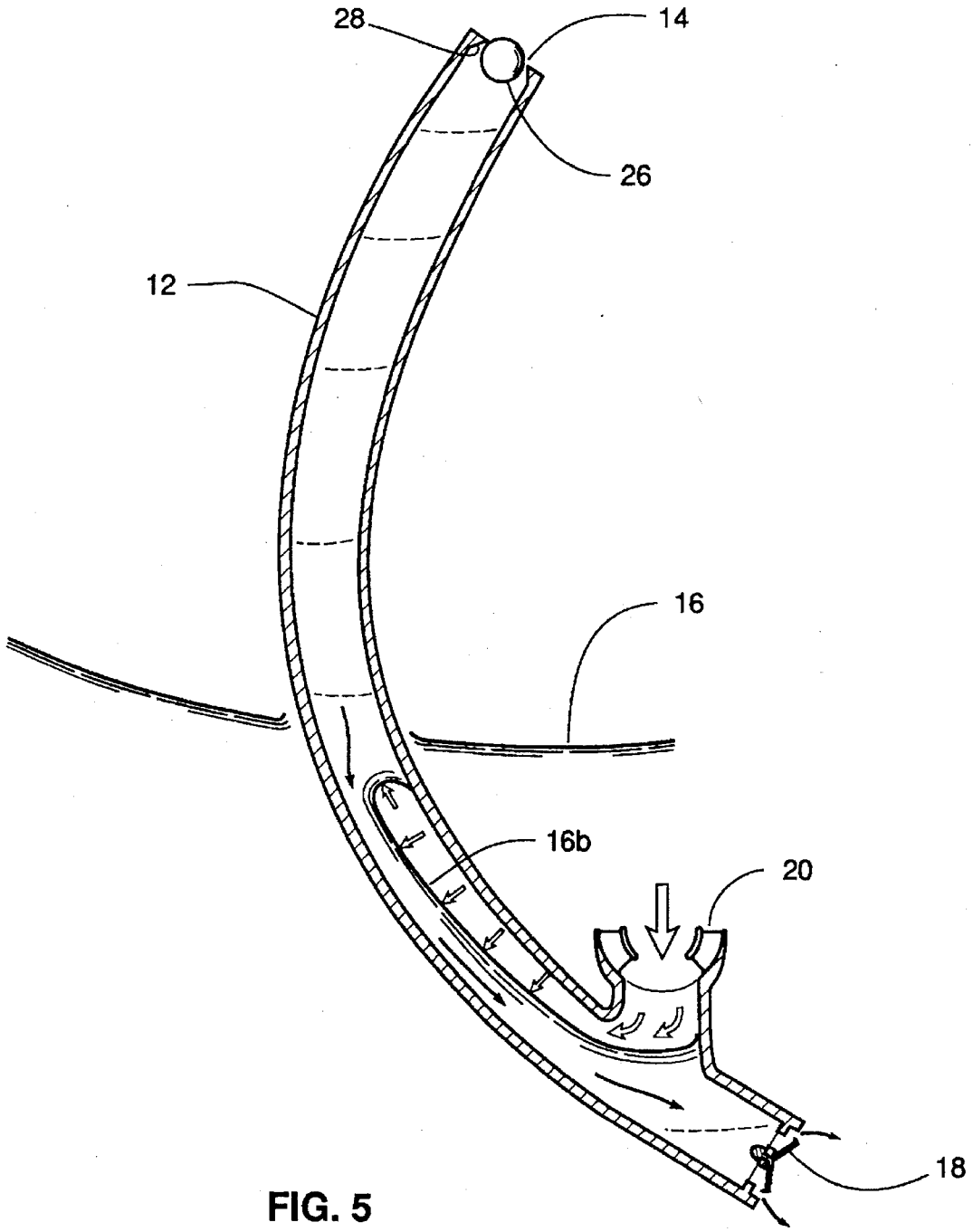
FIG. 5 is a view similar to FIG. 2, showing the snorkel during a purging exhalation.

After surface **16*a* drops to the level of ambient surface 16, water remaining in conduit 12 is purged by exhaling air into mouthpiece 20 (depicted as a large outline arrow in FIG. 5). Referring to FIG. 5, surface tension forms the exhaled air into a bubble having surface 16*b* which expands into conduit 12. As the leading surface of the bubble moves away from mouthpiece 20, the bulk of water within conduit 12 is pushed ahead of the bubble and lifted toward opening 14**.

Referring again to FIG. 5, a purging exhalation has lifted the water in conduit 12 until mobile member 26 blocked continued upward flow. Because upward flow is blocked, the expanding exhaled air (depicted as small outline arrows) moves through the water in conduit 12 and accumulates below mobile member 26. The accumulating air displaces the water in conduit 12, forcing the water down and out purge valve 18.

The purging exhalation should be no more than an non-forced, normal exhalation. In fact, an explosive exhalation typical of the prior art is not required or desirable. As a consequence, snorkel 10 can be purged with practically no respiratory effort, and with the expenditure of very little air. The actual amount of air required is equal to the internal volume of the snorkel, typically 10 cubic inches or 160 cubic centimeters. In addition, the entire purging sequence can take place automatically, that is, without conscious effort by the diver.

An explosive exhalation is characterized by a forced, fast expulsion of air. A forced, fast exhalation may not provide enough time for all of the water in the snorkel to be displaced. In addition, an explosive exhalation is not desirable because part of the air will wastefully dissipate through the nearby purge valve.

Figure 6:
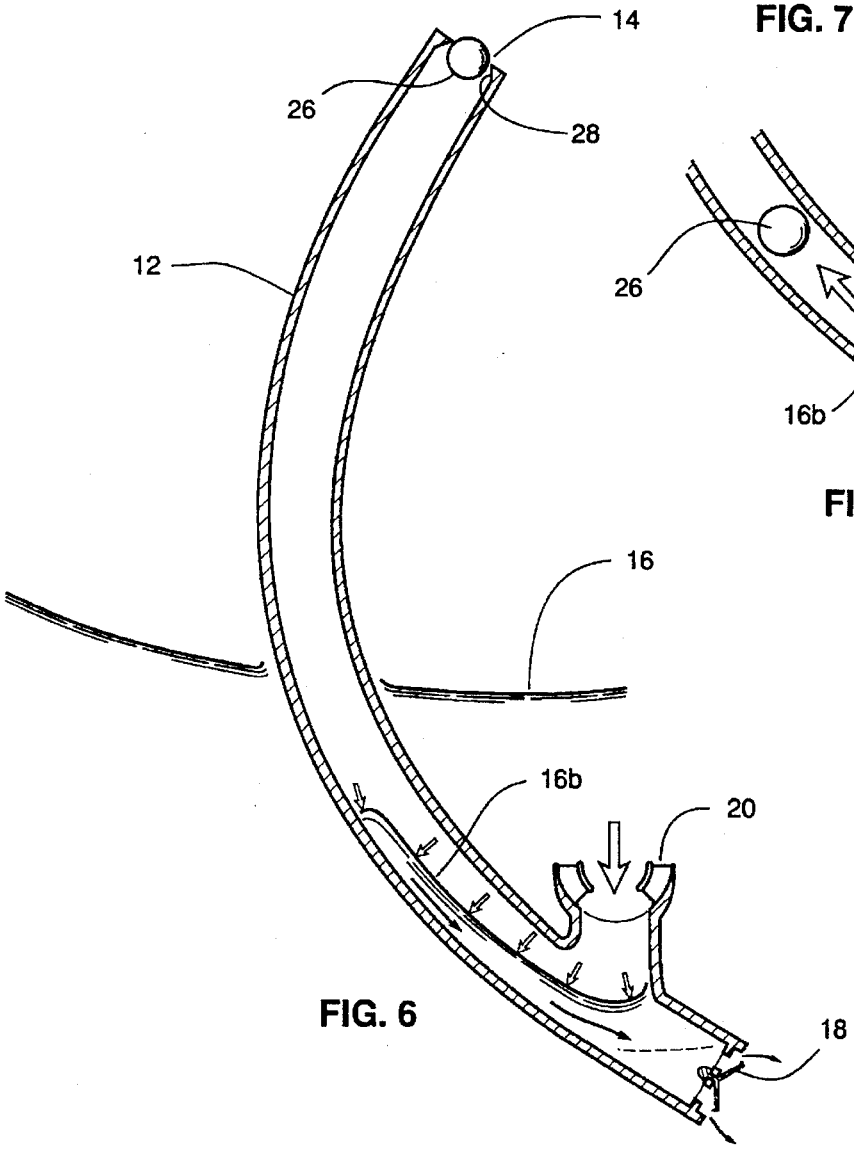
FIG. 6 is a view similar to FIG. 5, showing the snorkel during a continuing purging exhalation.

Referring to FIG. 6, when surface **16*b* drops away from mobile member 26, the buoyant force holding it against seat 28 is removed, but exhalation pressure maintains mobile member 26 against seat 28 until the purging exhalation is complete. Release of exhalation pressure at the start of inhalation allows mobile member 26 to immediately drop to the bottom of conduit 12, clearing conduit 12** for unobstructed respiration.

Allowing mobile member 26 to freely run the length of conduit 12 is contrary to conventional wisdom of the prior art. Successful prior art has avoided the placement of any obstruction within the respiratory flow path. However, with the instant invention this deviation from conventional wisdom is acceptable because mobile member 26 does not obstruct the respiratory flow path when water is not flooding conduit 12. Mobile member 26 only moves into the respiratory path of conduit 12 when undesirable amounts of water are present within the snorkel.

The upward movement of expanding exhaled air in flooded conduit 12 can impede the downward movement of water toward purge valve 18. The purging process can be quickened by providing conduit 12 with an elliptical cross section or the like. With an elliptical cross section, the ascending bubble of air will tend to maintain a circular cross section which travels up the center of the conduit, allowing water to flow down the rest of the elliptical cross section unimpeded.

Figure 7:
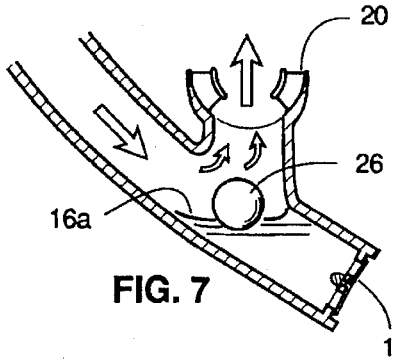
FIG. 7 is a partial view of the snorkel of FIG. 2 showing inhalation flow when the snorkel is only partially flooded with water.

Water which splashes into opening 14, due to swimming movements or wave action or the like, will accumulate in conduit 12 above purge valve 18. Similarly, fluids from the mouth, and residual water which adheres to the inner surface of conduit 12 after a purging exhalation, will accumulate above purge valve 18 as shown in FIG. 7. The length of conduit 12 below mouthpiece 20 is advantageously sized to hold residual water which remains after a purging exhalation and also small amounts of water which occasionally splash into opening 14. Empirical studies have determined that a volume equivalent to ten percent (10%) of the snorkel's total internal volume is sufficient for this purpose.

Figure 8:
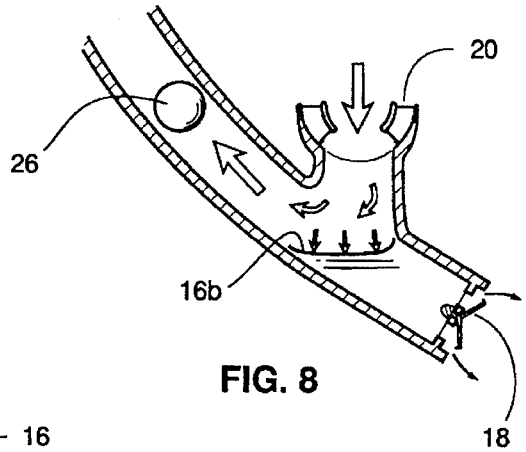
FIG. 8 is a partial view of the snorkel of FIG. 2 showing exhalation flow when the snorkel is only partially flooded with water.

Referring again to FIG. 7, even though some water has accumulated below mouthpiece 20, inhalation flow remains unimpeded. However, as seen in FIG. 8, exhalation flow will catch mobile member 26 and carry it along conduit 12 until it rests against seat 28, thereby blocking opening 14. As soon as exhalation flow through opening 14 is blocked, continued exhalation will force the accumulated water out purge valve 18. In this manner, snorkel 10, without conscious effort by the diver, will automatically purge itself of undesirable water which accumulates during the course of normal respiration.

Figure 9:
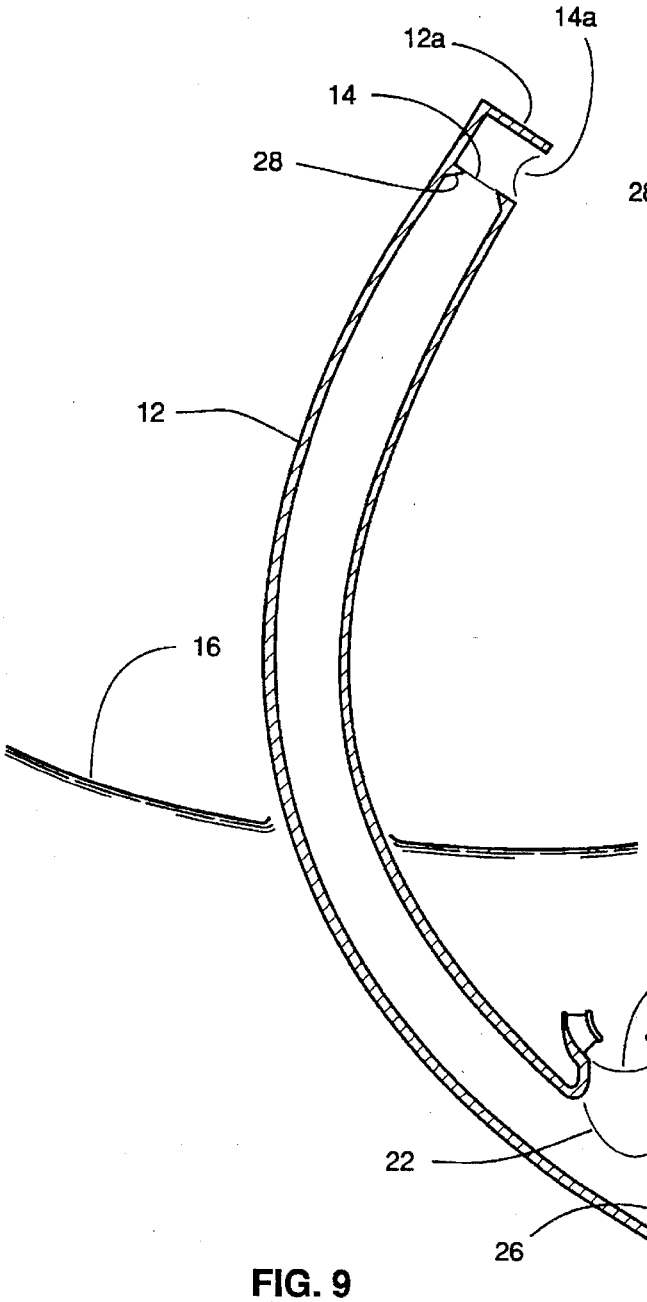
FIG. 9 is a view similar to FIG. 2, showing an alternate configuration.

Referring to FIG. 9, there is shown an alternate snorkel configuration in which the top of conduit 12 is covered with wall **12*a* and the conduit is opened to ambient through side opening 14*a*. Opening 14*a* is positioned between seat 28 and wall 12*a*. The configuration of FIG. 9** prevents water from splashing from overhead into the conduit but does not significantly interfere with respiratory flow.

Figure 10:
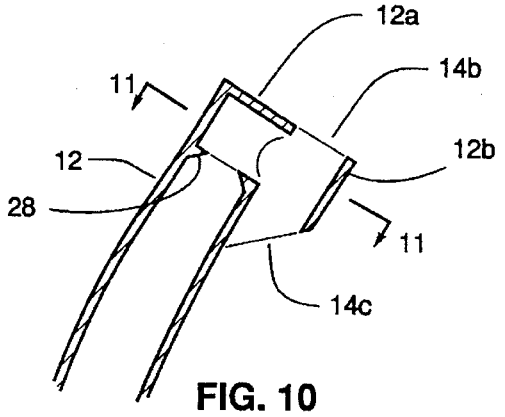
FIG. 10 is a partial view showing an alternate configuration incorporating a splash blocking extension.
Figure 11:
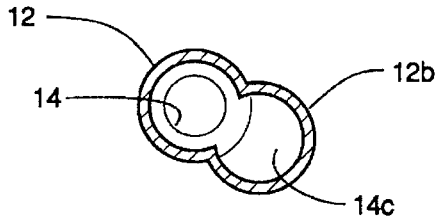
FIG. 11 is a sectional view of the snorkel of FIG. 10, taken along a plane corresponding to line 11—11.

Referring to FIGS. 10 and 11, the configuration of FIG. 9 is further enhanced by the addition of wall 12*b*. Wall 12*b* prevents water from splashing directly into opening 14*a*. Wall 12*b* has top and bottom openings 14*b* and 14*c* for unrestricted respiratory flow. Opening 14*c* is angled to prevent snagging.

Figure 12:
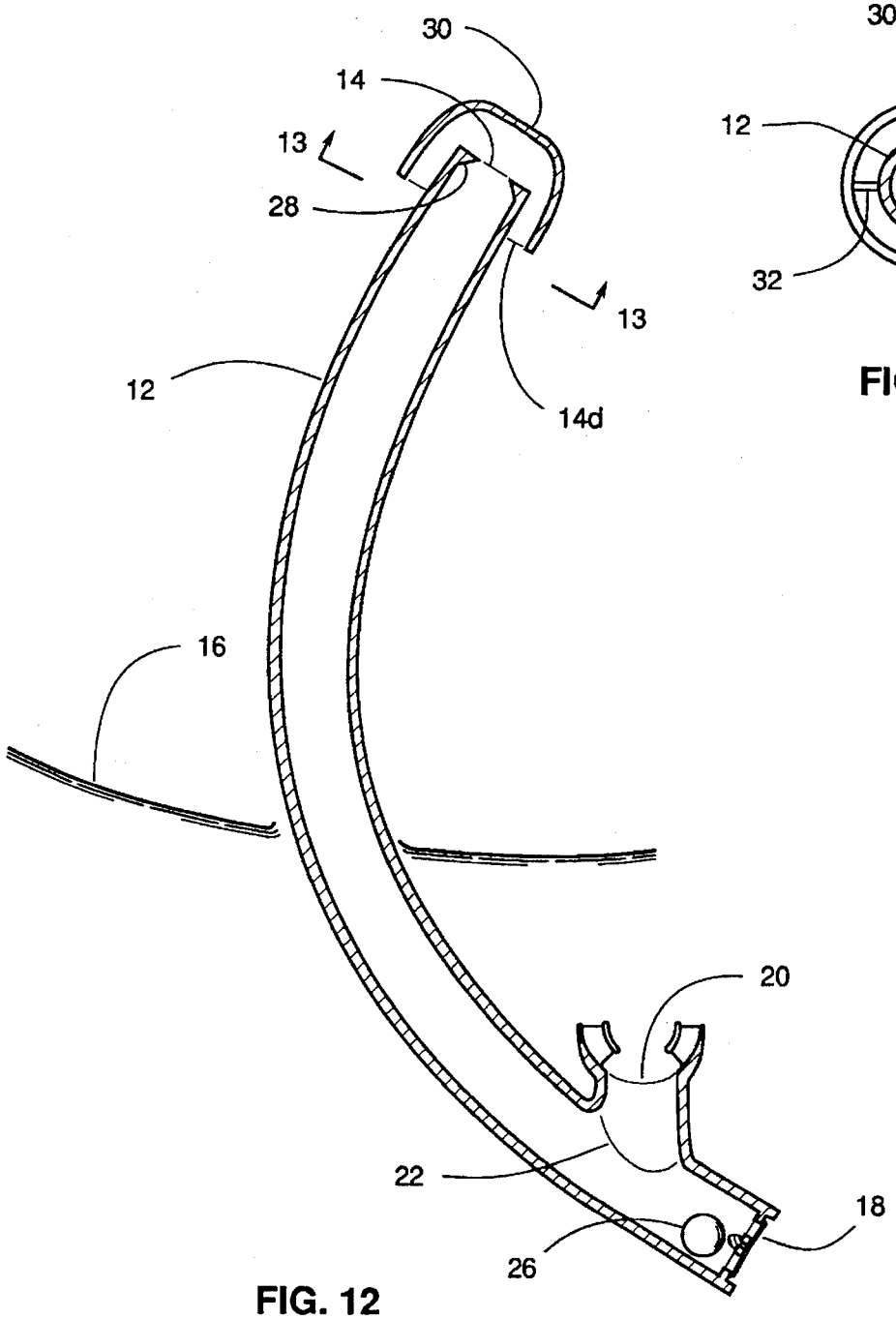
FIG. 12 is a view similar to FIG. 2, showing another alternate configuration incorporating a splash blocking extension.
Figure 13:
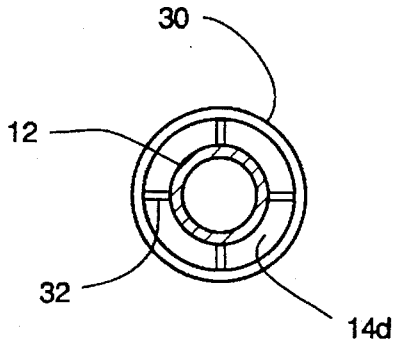
FIG. 13 is a sectional view of the snorkel of FIG. 10, taken along a plane corresponding to line 13—13.

Referring to FIGS. 12 and 13, conduit 12 is capped with inverted cup 30. Cup 30 is attached to conduit 12 by ribs 32 or the like. Annular opening 14*d* is sized to provide unrestricted respiratory flow. The configuration of FIGS. 12 and 13 prevent water from splashing into the conduit.

The water blocking structures exemplified by FIGS. 9, 10 and 12 have practical utility only with the instant invention. The installation of such splash blocking structures on snorkels of the prior art would significantly impede the passage of water through the open end during purging.

Figure 3:
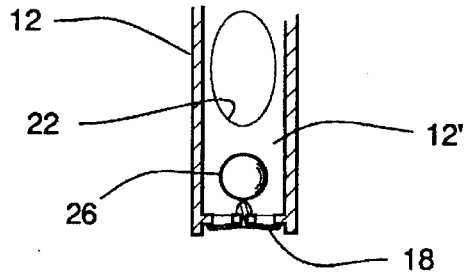
FIG. 3 is a partial sectional view of the snorkel, taken along a plane corresponding to line 3—3 of FIG. 2.
Figure 14:
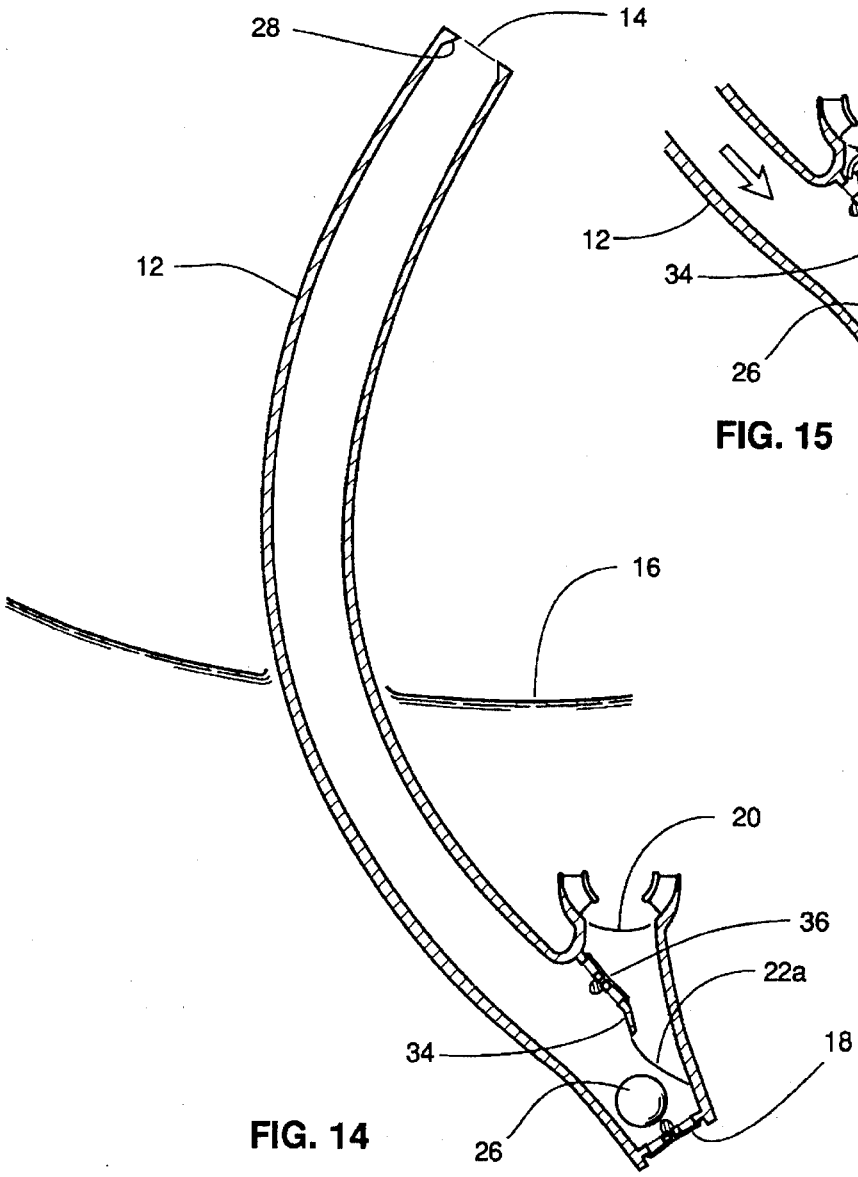
FIG. 14 is a view similar to FIG. 2, showing yet another alternate configuration.

Referring to FIG. 14, there is shown yet another snorkel configuration in which the upper portion of opening 22 (the opening formed by the intersection of mouthpiece 20 with conduit 12, see FIG. 3) is blocked by wall 34. The remaining opening 22*a* is advantageously sized to provide unrestricted respiratory flow.

Wall 34 has an aperture covered by check valve 36. When the snorkel is in use by a swimmer, check valve 36 is located a relatively short distance above opening 22*a*. Check valve 36 is oriented to allow unrestricted inhalation flow from conduit 12 into mouthpiece 20. Check valve 36 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, check valve 36 will prevent reverse flow through wall 34 into conduit 12.

Figure 15:
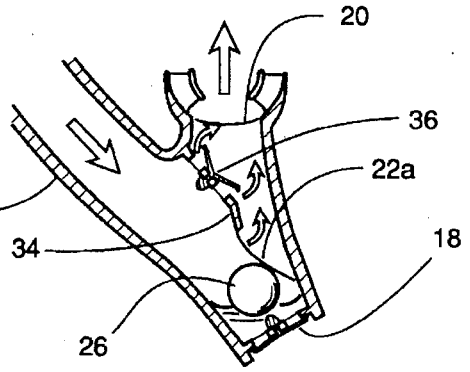
FIG. 15 is a partial view of the snorkel of FIG. 14 showing inhalation flow when the snorkel has little or no water in it.

Referring to FIG. 15, when conduit 12 contains little or no water, inhalation flow (depicted by outline arrows) moves freely through both opening 22*a* and check valve 36 into mouthpiece 20. Conversely, referring to FIG. 16, when conduit 12 contains little or no water, exhalation flow (depicted as outline arrows) moves freely through opening 22*a* into conduit 12.

Figures 16, 17, 18:
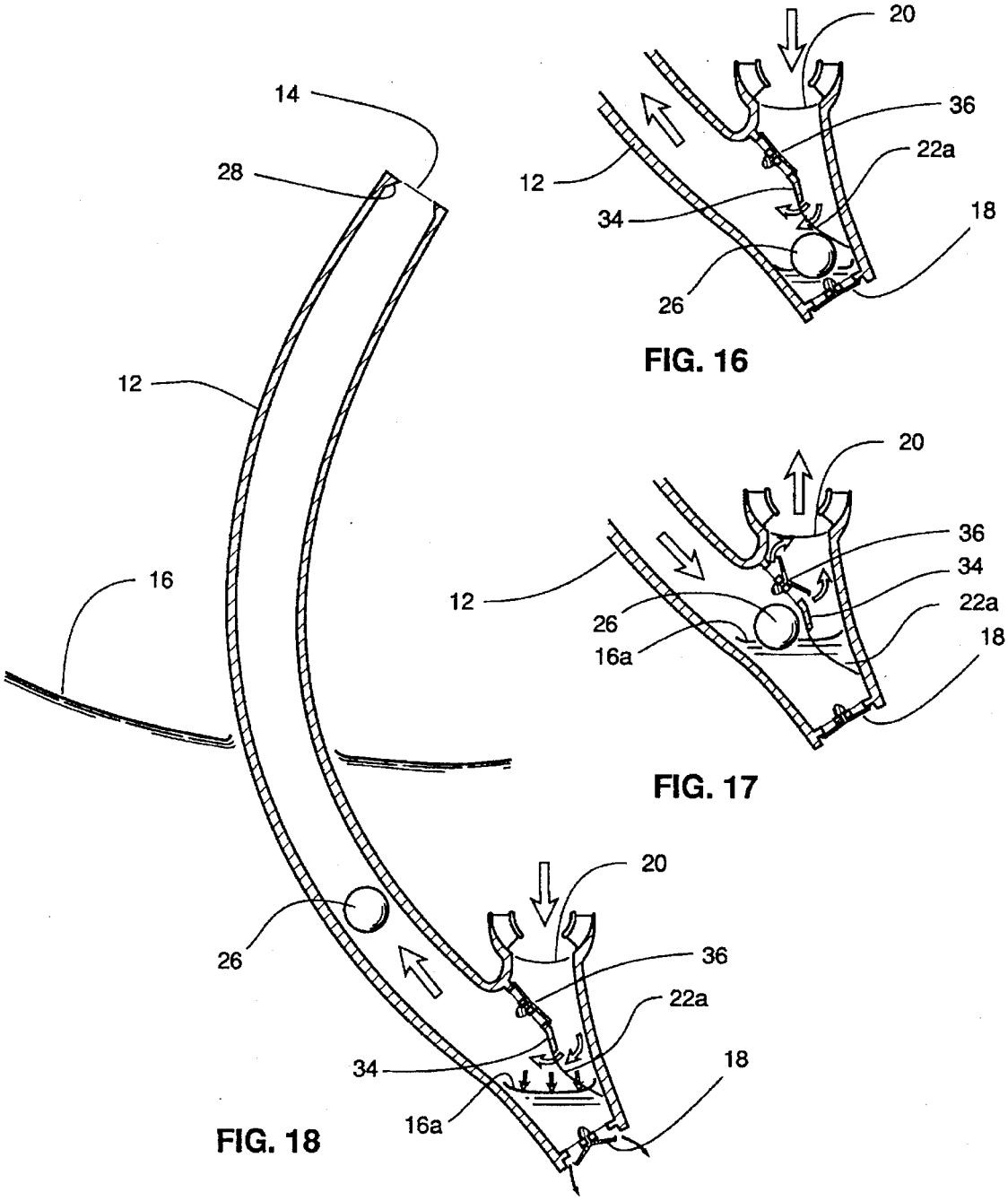
FIG. 16 is a partial view of the snorkel of FIG. 14 showing exhalation flow when the snorkel has little or no water in it.
FIG. 17 is a partial view of the snorkel of FIG. 14 showing inhalation flow when the snorkel is partially flooded with water.
FIG. 18 is a view of the snorkel of FIG. 14 showing a purging exhalation.

Referring to FIG. 17, when conduit 12 is partially filled with water (caused, for example, by water splashing in through opening 14), opening 22*a* will be partially or totally blocked by the water, but inhalation flow will move freely through check valve 36 into mouthpiece 20. As long as check valve 36 is above the water, inhalation flow is unimpeded.

Referring to FIG. 18, exhalation can only flow through opening 22*a* into conduit 12. Consequently, when conduit 12 is partially filled with water, the water which covers opening 22*a* will be forced up conduit 12 by exhalation pressure. In addition, the upward water movement and exhalation flow will carry mobile member 26 upward. The upward movement of mobile member 26 into conduit 12 initiates the purging sequence described previously.

The FIG. 14 snorkel configuration has the advantage of automatically initiating the purging sequence when only very small amounts of water are in conduit 12, considerably before inhalation flow can be disrupted.

Figure 19:
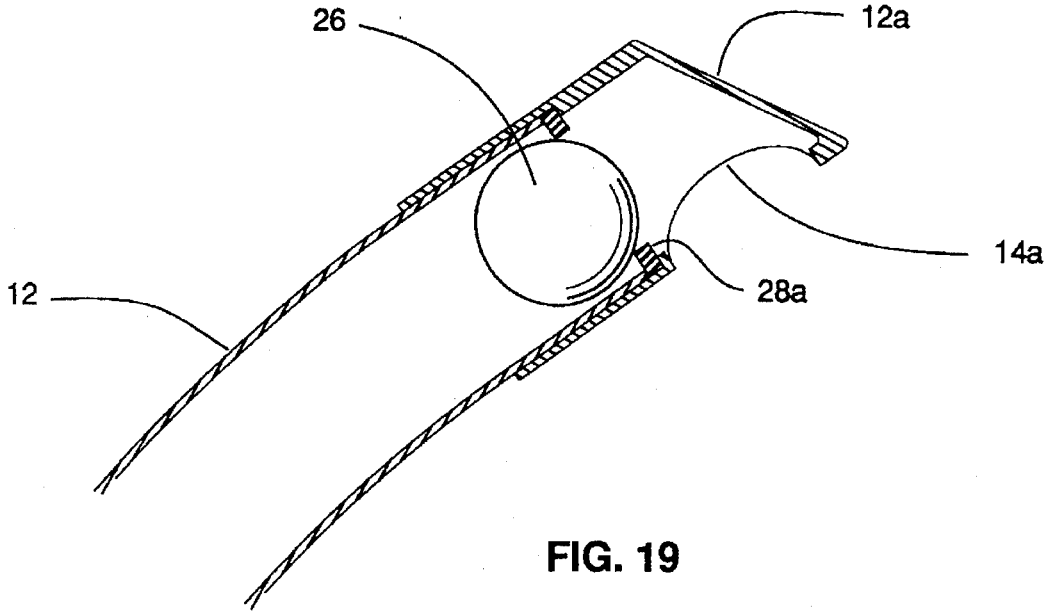
FIG. 19 is a partial view of the snorkel of FIG. 9, showing an alternate configuration.

In the preferred embodiment, seat 28 is a conical shelf, or the like, sized to nest spherical mobile member 26 such that a substantially airtight closure is achieved when mobile member 26 rests against it. Seat 28 can be a molded integral part of conduit 12. Alternately, as shown in FIG. 19, seat 28 can be separate elastomer washer 28*a*. Washer 28*a* is retained by an appropriate groove in the inside wall of conduit 12. Using elastomer seat 28*a* has the advantage of cushioning the impact of mobile member 26 during purging activities.

Figure 20:
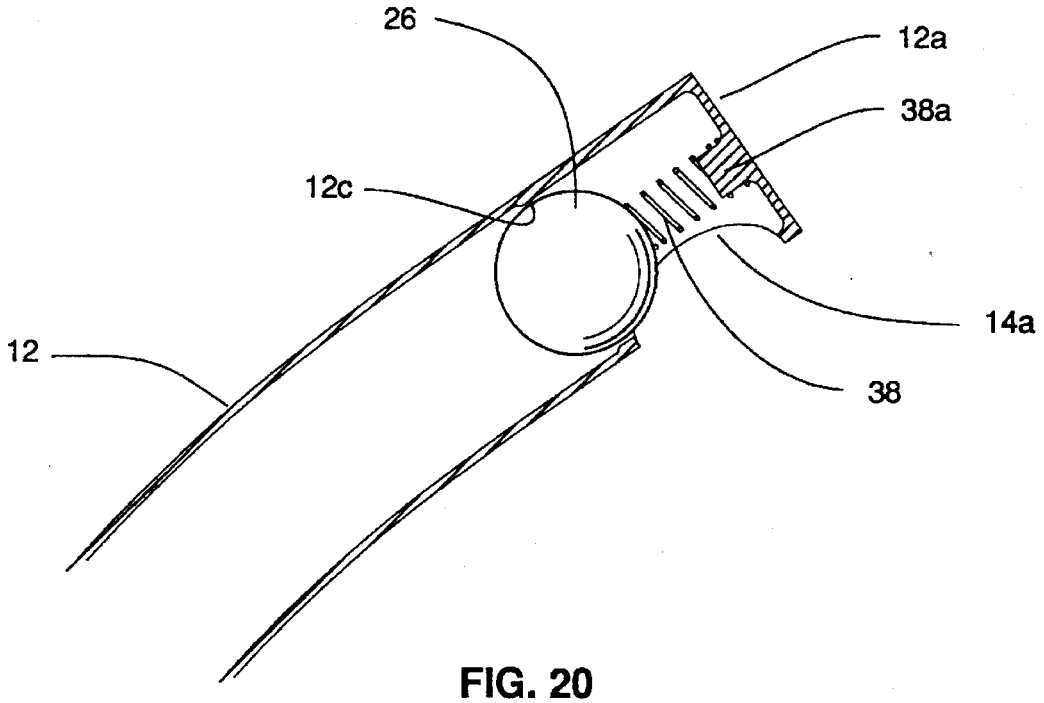
FIG. 20 is a partial view of the snorkel of FIG. 9, showing another alternate configuration.

Referring to FIG. 20, there is shown an alternate configuration in which flow blockage is achieved by the close clearance between the surface of mobile member 26 and the inside wall of conduit 12. To provide a close clearance, the inside cross section of conduit 12 can be reduced in size at 12*c*. Spring 38 in conjunction with end wall 12*a* prevents mobile member 26 from exiting the above water end of conduit 12. Spring 38 is attached to wall 12*a* by knob 38*a*. Alternately, spring 38 can be attached to wall 12*a* by a screw, or the like. Spring 38 serves to cushion the impact of mobile member 26 during purging activities. Alternately, spring 38 can be eliminated by extending knob 38*a* the appropriate distance.

The configuration of FIG. 20 eliminates the need for seat 28, and relies on the close clearance between mobile member 26 and inside wall 12*c* to provide a restriction which adequately blocks exhalation flow. Because the blockage is not airtight, some air will be lost during purging activities.

Novice or newly trained divers quickly learn how to properly purge the instant invention. However, divers experienced with snorkels of the prior art have been trained to purge a snorkel with a quick and explosive blast of air. For the instant invention, a quick and explosive blast of air can wastefully dissipate a significant part of the air through the nearby purge valve; and the shortness of the exhalation may not provide enough time for the expanding bubble of air within the instant invention to completely displace all of the water. Consequently, experienced prior art divers must overcome old habits and be retrained to purge the instant invention with a non-forced, normal exhalation.

The configuration of FIG. 20 provides an advantage when the instant invention is used by experienced divers who habitually purge with a forceful, explosive blast of air. The force of the explosive exhalation will cause mobile member 26 and spring 38 to function as a "relief valve" such that water forcefully rising within conduit 12 is able to quickly vent past member 26 through opening 14*a*. Another configuration which serves the same purpose places a vent opening in conduit 12 adjacent seat 28. Although forceful purging is not as efficient as using a normal, non-forceful purging exhalation, the relief valve function of mobile member 26 and spring 38, or a top vent in conduit 12, increases the general utility of the instant invention within the diving community for those who cannot overcome prior art training.

When a diver swims or dives below the water surface, water will pour into conduit 12 through opening 14. The downward force of the inward flowing water can hold mobile member 26 in the vicinity of mouthpiece 20. When conduit 12 is nearly flooded, the force of the flow will be abated and mobile member 26 will be buoyed upward toward seat 28. If the diver abruptly returns to the surface before mobile member 26 has reached seat 28, downward drainage of water through purge valve 18 (as depicted in FIG. 4.) can capture mobile member 26 and momentarily force it against purge valve 18. The temporary immobilization of mobile member 26 defeats, for a short time, its function.

Figure 21:
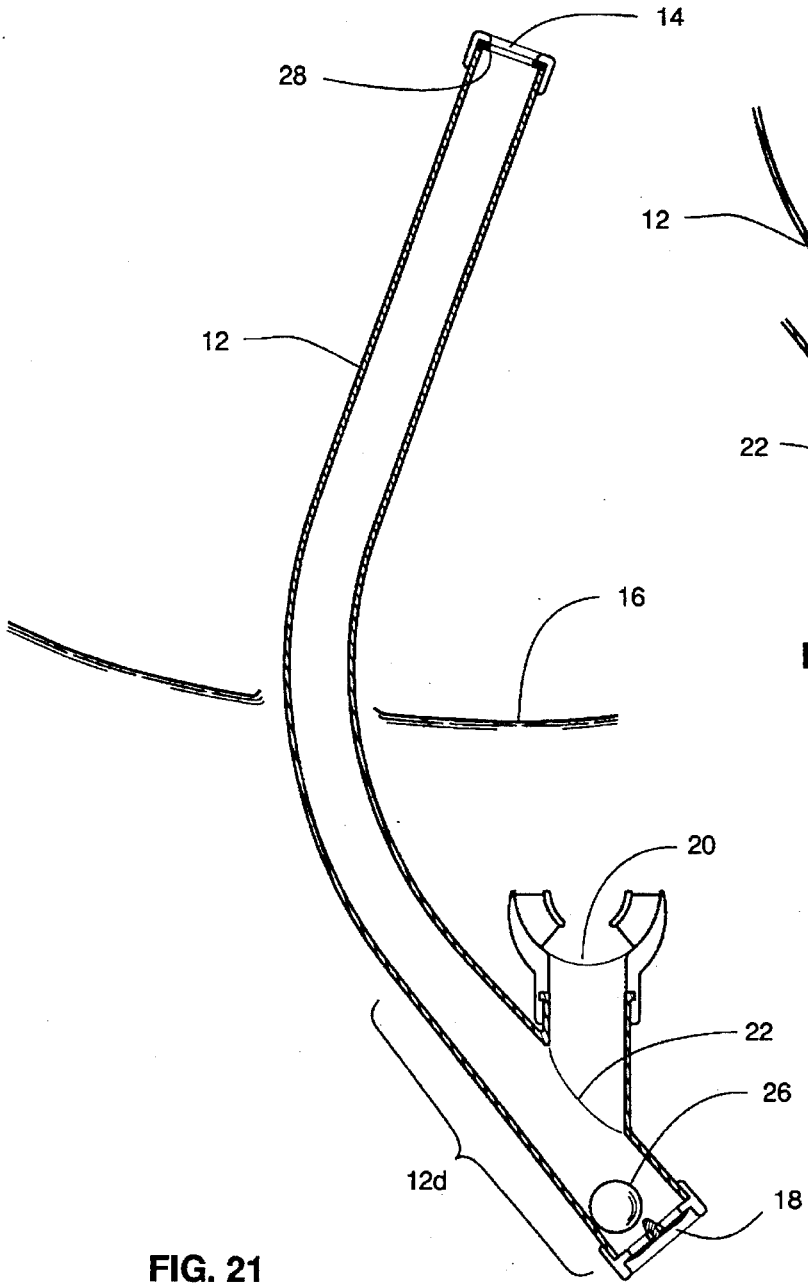
FIG. 21 is a view similar to FIG. 2, showing yet another alternate configuration.

Referring to FIG. 21, there is shown a configuration featuring a gradual increase of the inside diameter of conduit 12 along the length 12*d* adjacent mouthpiece 20 and purge valve 18. Alternately, the increase of the inside diameter of conduit 12 along the length 12*d* can occur abruptly. Typically, length 12*d* is one-quarter (¼) to one-third (⅓) the overall length of conduit 12. Increasing the inside diameter accommodates a larger purge valve. More importantly, the increased inside diameter of conduit 12 in the vicinity of mouthpiece 20 provides greater clearance for water flow around mobile member 26, thereby preventing temporary immobilization of mobile member 26 against purge valve 18 as described supra.

Figure 22:
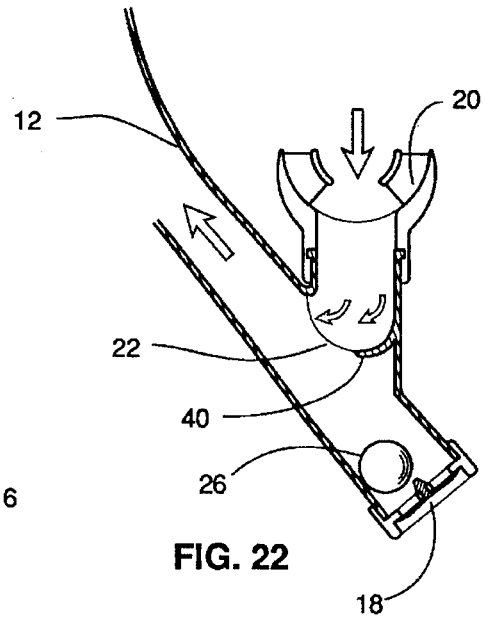
FIG. 22 is a partial view showing an alternate configuration of the snorkel of FIG. 21 during exhalation flow when the snorkel has little or no water in it.

The configuration of FIG. 22 features deflecting wall 40. Deflecting wall 40 serves to guide the exhalation, as depicted by the outline arrows, directly up conduit 12 toward opening 14. Guiding the exhalation flow upward has the benefit of hastening the purging of conduit 12. Although deflecting wall 40 is pictured as a single curving wall, deflecting wall 40 can be any one of a number of straight or curved shapes and configurations, including but not limited to, multiple baffles, vanes or walls.

The instant invention can be adapted to a variety of snorkel configurations. For example, FIG. 23 shows the instant invention adapted to the snorkel configuration described in the applicant's application Ser. No. 107,987 filed Oct. 13, 1987 now U.S. Pat. No. 4,879,995. U.S. Pat. No. 4,879,995 teaches a conduit whose length is divided by a bell shaped chamber. The bell shaped chamber captures water which splashes into the open end of the conduit. The captured water is discharged through an annular purge valve located at the base of the chamber. For the instant invention, seat 28 is most advantageously located adjacent the chamber purge valve at approximately mid-length of conduit 12. The chamber purge valve drains the chamber and upper conduit 12*g* of water when the diver returns to the surface after swimming or diving underwater. The instant invention enhances the purging of water from lower conduit 12*h*. The configuration of FIG. 23 illustrates that seat 28, or the like, can be advantageously located anywhere along the length of conduit 12.

Other variations on the diameter, cross-section shape and radius of curvature of the conduit; various splash blocking structures and coverings; various shapes and types of mobile members, the use of multiple mobile members, and various methods to adjust the mouthpiece location relative to the conduit are contemplated. It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A snorkel device comprising:

a conduit means having first and second ends thereof;

said conduit first end being fully open and freely admits ambient fluid into said conduit;

valve means adjacent said conduit second end, said valve means arranged to selectively provide unidirectional flow from said conduit means to ambient;

mouthpiece means joined to said conduit means and communicating fluid flow with said conduit means;

a mobile member situated in said conduit means, said mobile member spherically shaped in its entirety; said mobile member substantially restricting fluid flow to ambient through said conduit first end when said conduit means contains significant amounts of water;

seat means adjacent said conduit first end, said seat means forms a substantially flow blocking closure with said mobile member when said mobile member is resting against it; and said mobile member also substantially restricting exhalation flow through said conduit first end when said mobile member is resting against seat means.

2. The snorkel device recited in claim 1 wherein:

said conduit means defines a substantially smooth and unobstructed respiratory flow path between said first end of said conduit means and said mouthpiece means.

3. The snorkel device recited in claim 1 wherein:

the entirety of said mobile member resides intermediate said mouthpiece means and said conduit second end when said conduit does not contain significant amounts of water.

4. The snorkel device recited in claim 1 wherein:

said mobile member has a specific gravity which provides buoyancy in water.

5. The snorkel device recited in claim 1 wherein:

said valve means includes flexible diaphragm means mounted to selectively open under pressure thereby to permit unidirectional flow from the interior of said conduit means to ambient.

6. The snorkel device recited in claim 1 wherein:

said conduit first end opening is in the side wall of said conduit means.

7. The snorkel device recited in claim 6 including:

water blocking means external to said conduit means and adjacent said conduit first end opening.

8. The snorkel device recited in claim 1 including:

restraining means adjacent said conduit first end, said restraining means maintaining said mobile member within said conduit means.

9. The snorkel device recited in claim 1 wherein: said seat means comprises a conical shelf.

10. A snorkel device comprising:

a conduit adapted to extend above the water surface when said snorkel device is used by a diver swimming face down on the water surface, said conduit having first and second ends thereof;

said conduit first end being fully open whereby it freely admits air into said snorkel device;

said conduit second end joined to valve means, said valve means arranged to selectively provide unidirectional flow to ambient from the interior of said conduit;

mouthpiece means joined to said conduit and communicating fluid flow with said conduit;

a respiratory flow path defined by that portion of said conduit between said conduit first end and said mouthpiece means;

said respiratory flow path being a substantially smooth and fully clear passage;

a buoyant member movably situated in said conduit, said buoyant member spherically shaped in its entirety; said buoyant member selectively traveling toward said conduit first end thereby substantially restricting fluid flow to ambient through said conduit first end when significant amounts of water accumulates in said conduit;

said conduit means Incorporates seat means between said first and second ends, said seat means forms a substantially flow blocking closure with said buoyant member when said mobile member is resting against it; and said buoyant member also selectively traveling into said respiratory flow path during exhalation thereby substantially restricting exhalation flow through said conduit first end when said mobile member is resting against said seat means.

11. The snorkel device recited in claim 10 wherein:

said mouthpiece means is located intermediate said conduit first and second ends.

12. The snorkel device recited in claim 10 wherein:

the entirety of said buoyant member resides intermediate said mouthpiece means and said conduit second end when said conduit does not contain significant amounts of water.

13. The snorkel device recited in claim 10 wherein:

said respiratory flow path is curved.

14. A snorkel device comprising:

a conduit means having first and second ends thereof;

said first end of said conduit means admits ambient fluid into said conduit;

mouthpiece means adjacent said second end of said conduit means, said mouthpiece means communicating fluid flow with said conduit means;

said conduit means defines a substantially smooth and unobstructed respiratory flow path between said first end of said conduit means and said mouthpiece means;

a chamber having valve means situated therein, said valve means arranged to selectively provide unidirectional flow from said chamber to ambient;

said chamber situated between said mouthpiece means and said valve means, said chamber joined to communicate fluid flow with said conduit means;

a mobile member situated in its entirety in said chamber when said chamber is substantially dry;

said mobile member selectively moving into said conduit means when a significant amount of water has accumulated in said chamber thereby substantially restricting exhalation flow through said first end of said conduit means;

said conduit means incorporates seat means between said first and second ends, said seat means forms a substantially flow blocking closure with said mobile member when said mobile member is resting against it; and said mobile member also substantially restricting fluid flow to ambient through said first end of said conduit when said mobile member is resting against said seat means.

15. The snorkel device recited in claim 14 wherein:

said first end of said conduit means incorporates adjacent seat means, said seat means forms a substantially flow obstructing closure with said mobile member when said mobile member is adjacent said conduit first end.

16. The snorkel device recited in claim 14 wherein:

said mobile member has a specific gravity which provides buoyancy in water.

* * * * *